United States Patent [19]

Buckshaw

[11] 4,295,019

[45] Oct. 13, 1981

[54] WATER LEVEL CONTROL DEVICE AND METHOD OF MAKING THE SAME

[75] Inventor: Thomas M. Buckshaw, Indiana, Pa.

[73] Assignee: Robertshaw Controls Company, Richmond, Va.

[21] Appl. No.: 87,753

[22] Filed: Oct. 24, 1979

[51] Int. Cl.[3] ..... H01H 35/34

[52] U.S. Cl. ..... 200/61.2; 200/83 WM; 200/83 S; 137/392; 74/107

[58] Field of Search ..... 200/81 R, 83 R, 83 S, 200/83 WM, 84 R, 84 B, 61.2, 153 L, 153 LA, 324, 325; 74/107; 337/318-320, 118; 137/387, 392; 73/717, 723

[56] References Cited

U.S. PATENT DOCUMENTS 3,249,712 5/1966 Rhodes ..... 200/83 WM
3,291,932 12/1966 Main ..... 200/83 WM
3,359,387 12/1967 Rhodes ..... 200/83 WM
3,579,284 5/1971 Mason ..... 200/83 WM

*Primary Examiner*—Gerald P. Tolin
*Attorney, Agent, or Firm*—Candor, Candor & Tassone

[57] ABSTRACT

A water level control device having a cam follower for setting the desired water level setting for the control device and a movable cam member having a cam surface engaging the cam follower to set the same in desired positions, the cam surface having a reset portion for resetting the control device when the reset portion is disposed against the cam follower. The cam member has an integral spring that cooperates with the control device to tend to move the cam member from its resetting position when the reset portion is disposed against the cam follower, the cam member and spring being homogeneous and thereby comprising a one-piece homogeneous structure.

12 Claims, 4 Drawing Figures

WATER LEVEL CONTROL DEVICE AND METHOD OF MAKING THE SAME

BACKGROUND OF THE INVENTION

1. Field of the Invention

This invention relates to an improved water level control device and to a method of making the same.

2. Prior Art Statement

It is known to provide a water level control device having a cam follower for setting the desired water level setting for the control device and a movable cam means having a cam surface engaging the cam follower to set the same in desired positions, the cam surface having a reset portion for resetting the control device when the reset portion is disposed against the cam follower and the control device having spring means cooperating with the cam means to tend to move the cam member from its resetting position when the reset portion is disposed against the cam follower.

For example, see the following two U.S. patents:

(1) U.S. Pat. No. 3,249,712— Rhodes et al.

(2) U.S. Pat. No. 3,359,387—Rhodes

It appears that each water level control device of items (1) and (2) above has the spring means that is operated on by the cam follower to provide the force for moving the cam member from its resetting position.

However, other prior known water level control devices have springs separate from the range springs and separate from the cam means for acting on the cam means to tend to return the cam means from their respective resetting positions.

SUMMARY OF THE INVENTION

One feature of this invention is to provide a water level control device having an improved cam means for operating on the cam follower thereof for setting the desired water level setting for the control device.

In particular, it was found according to the teachings of this invention that the cam means of a water level control device can carry an integral spring means that will cooperate with the control device to tend to move the cam means from its resetting position without relying upon the force of the spring means being acted upon by the cam follower of the control device for such purpose as in certain prior known water level control devices or without requiring a separate spring as in other prior known water level control devices.

Thus, one embodiment of this invention provides a water level control device having a cam follower for setting the desired water level setting for the control device and a movable cam means having a cam surface engaging the cam follower to set the same in desired positions, the cam surface having a reset portion for resetting the control device when the reset portion is disposed against the cam follower. The cam means carries an integral and homogeneous spring means that cooperates with the control device to tend to move the cam means from its resetting position when the reset portion is disposed against the cam follower the cam means and spring means being homogeneous and thereby comprising a one-piece homogeneous structure.

The cam means and the spring means of this invention can comprise a one-piece plastic structure wherein the spring means has a natural bias to cooperate with a stop of the control device to tend to move the cam means from its resetting position when the reset portion of the cam means is disposed against the cam follower.

Accordingly, it is an object of this invention to provide an improved water level control device having one or more of the novel features of this invention as set forth above or hereinafter shown or described.

Another object of this invention is to provide a method of making such a water level control device, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
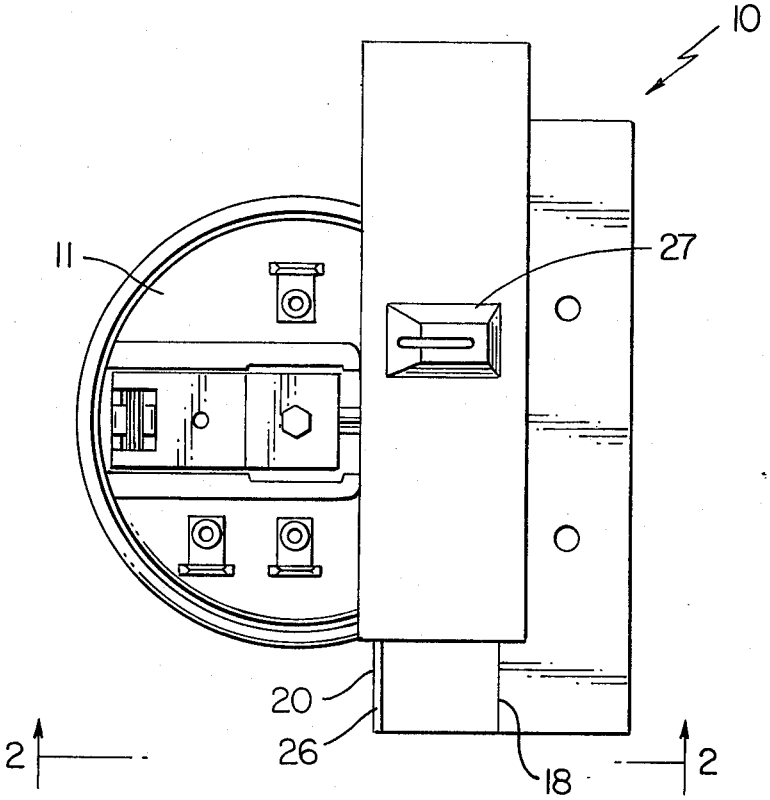
FIG. 1 is a top view of the improved water level control device of this invention.

While the various features of this invention are hereinafter described and illustrated as being particularly adapted to provide a water level control device for a laundry machine, it is to be understood that the various features of this invention can be utilized singly or in any combination thereof to provide a pressure responsive control device for other purposes and apparatus as desired.

Therefore, this invention is not to be limited to only the embodiment illustrated in the drawings, because the drawings are merely utilized to illustrate one of the wide variety of uses of this invention.

Figure 2:
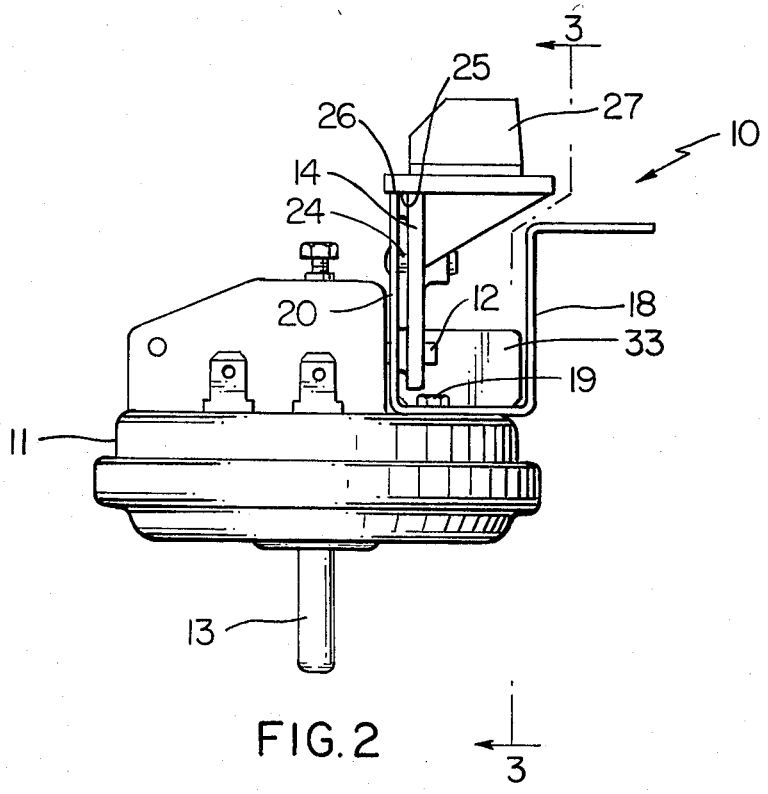
FIG. 2 is a side view of the water level control device of FIG. 1 and is taken in the direction of the arrows 2—2 of FIG. 1.

Referring now to FIGS. 1 and 2, the improved water level control device of this invention is generally indicated by the reference numeral 10 and comprises a housing means 11 having a movable cam follower 12 to be set in various positions thereof as will be apparent hereinafter to control the level of water being directed into a laundry chamber (not shown) of a laundry apparatus (not shown) in a manner well known in the art.

For example, see the aforementioned U.S. Pat. No. 3,249,712 and U.S. Pat. No. 3,359,387 for the details of the structure and operation of water level control devices that control the water filling operations of laundry machines or the like and such U.S. patents are incorporated herein by reference.

In fact, the water level control device 10 of this invention is of substantially the same type as set forth in the above U.S. Pat. No. 3,249,712 to Rhoades et al., wherein the cam follower 122 of such patent to Rhodes et al corresponds to the cam follower 12 illustrated in FIGS. 1–4 of this application.

Thus, it can be seen that the air pressure created by the filling of the laundry chamber with water is adapted to be directed to the water level control device 10 by a flexible conduit (not shown) interconnected to a nipple 13 of the housing means 11 to pressurize a chamber therein that has a flexible diaphragm adapted to act on an electrical switch within the housing means 11 that causes a termination of the water filling operation when the level thereof reaches the level that has been selected by the cam follower 12.

The means for setting the cam follower 12 of the water level control device 10 of this invention comprises a movable cam member 14 that is a one-piece plastic part and is adapted to slide relative to the housing means 11 of the control device 10 in a manner hereinafter set forth so that a cam surface 15, FIGS. 3 and 4, can act on the cam follower 12 to set the same in any desired setting position thereof between a maximum low water level setting when a portion 16 of the cam surface 15 is disposed against the cam follower 12 and a maximum high water level setting when a portion 17 of the cam surface 15 is disposed against the cam follower 12 in the manner illustrated in FIG. 3.

Thus, it can be seen that the cam surface 15 is infinitely variable between the low setting portion 16 thereof and high setting portion 17 as the slide member 14 is moved relative to the housing means 11.

In particular, the housing means 11 carries a U-shaped bracket member 18 secured thereto by suitable fastening means 19 and has an upstanding flange 20 provided with an elongated slot 21 having opposed ends 22 and 23 and receiving a cylindrical pin 24 of the slide member 14 therein to guide and limit sliding movement of the slide member 14 relative to the housing means 11.

A shoulder 25 of the slide member 14 bears against an upper surface 26 of the flange 20 of the bracket 18 to assure straight line movement of the slide member 14 relative to the housing means 11 while suitable interference fit between the surfaces 25, 26 and/or interference fit between the pin 24 and slot 21 will assure that the position selected by the slide member 14 relative to the cam follower 12 will be maintained until the operator decides to slide the slide member 14 to a new water level setting position thereof by grasping a suitable handle portion 27 of the slide member 14 and positioning the slide member 14 in the new water level setting position thereof. Such positioning of the slide member 14 can be accomplished by having a suitable water level scale adjacent the handle 27 to indicate the level selected as is conventional in the art.

Also, as is well known in the water level control art, once a water level setting has been selected by the cam means 14 and the level of the water filling the laundry chamber has reached such level to cause the electrical switch means in the control device 10 to terminate the operation of the water filling operation, the cam means 14 cannot be thereafter set to a higher water level setting to cause a further filling of the laundry chamber with water unless the switch means in the water level control device 10 is reset by moving the cam follower 12 downwardly toward the housing means 11 to a resetting position thereof for the reasons fully set forth in the aforementioned U.S. patents.

Figure 3:
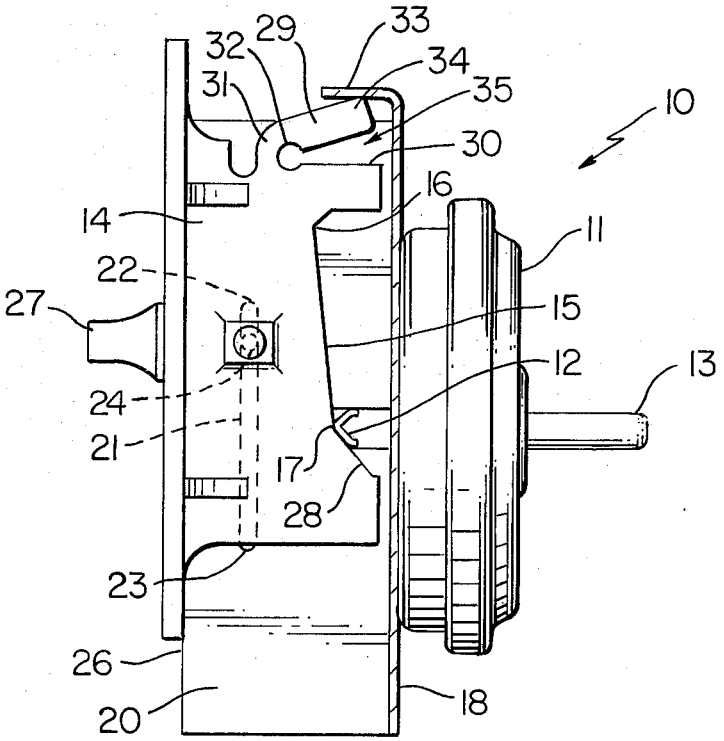
FIG. 3 is a cross-sectional view of the water level control device of FIG. 2 and is taken on the line 3—3 thereof.
Figure 4:
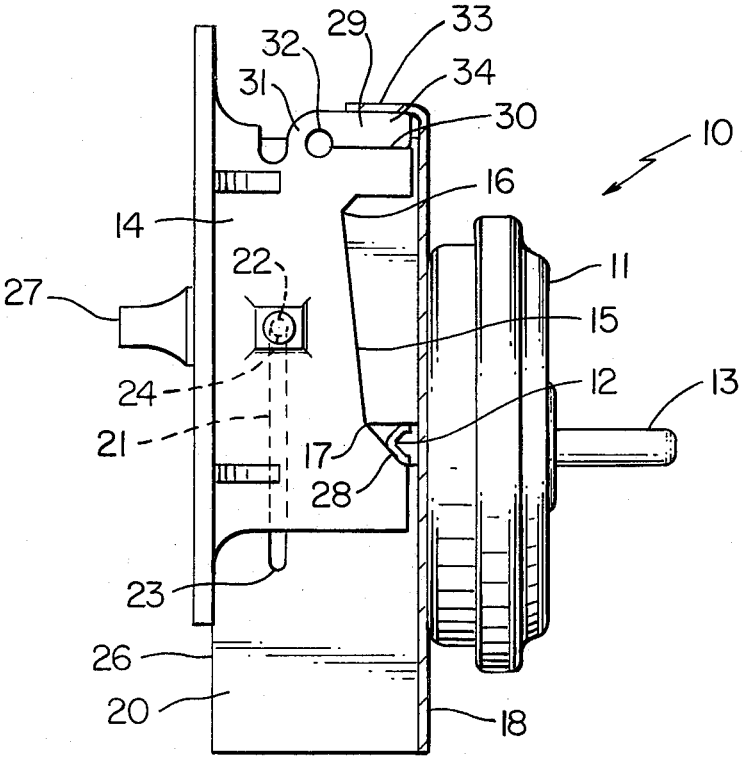
FIG. 4 is a view similar to FIG. 3 and illustrates the water level control device in its resetting position.

Accordingly, the cam surface 15 of the slide member 14 of this invention is provided with a steep reset portion 28 immediately adjacent the high water level setting portion 17 thereof so that as the slide member 14 is moved from the position as illustrated in FIG. 3 to the position illustrated in FIG. 4, the reset portion 28 of the cam surface 15 cams the cam follower 12 to its resetting position as illustrated in FIG. 4. In this manner, the switch means in the water level control device 10 is reset so that the operator can now utilize the slide member 14 to select a higher water level setting than the original setting thereof so that additional water can be added to the laundry chamber than was added during the initial level selection thereof as is well known in the art.

However, as previously stated certain prior known water level control devices each utilize the spring means operating on the cam follower to force the cam follower from its resetting position, such as is illustrated in FIG. 4, back to a high water level position, such as is illustrated in FIG. 3, if the operator does not immediately move the cam member to a new water level setting position thereof. Other prior known water level control devices each utilize a separate spring for this purpose.

It was found according to the teachings of this invention that such a requirement for the spring means inside the control device 10 of this invention that acts on the cam follower 12 to overcome the frictional force on the slide member 14 when the same is disposed in the resetting position of FIG. 4 is too great for such a spring and, therefore, an additional spring means should be provided to move the cam member 14 from the resetting position of FIG. 4 back to the position illustrated in FIG. 3.

Thus, it was found according to the teachings of this invention that the cam member 14 can carry such spring means and such spring means can form a one-piece structure therewith.

In particular, it can be seen that the slide member 14 is provided with an arm 29 that is normally disposed at an angle relative to a surface 30 of the slide member 14 and is interconnected to the slide member 14 by a hinge section 31 that is integral therewith and is defined adjacent a circular gap 32 provided between the arm 29 and the surface 30.

In this manner, by providing a stop member 33 for the control device 10, which in the embodiment illustrated comprises a flange of the bracket 18, the arm 29 will have its free end 34 engage against such stop 33 in the manner illustrated in FIG. 3 when the highest water level portion 14 of the cam surface 15 is disposed against the cam follower 12 so that upon further movement of the slide member 14 from the position illustrated in FIG. 3 to the position illustrated in FIG. 4 to effect a resetting operation of the control device 10 for the purpose previously set forth, the arm 29 is moved or flexed in opposition to the bias of its natural hinge portion 31 into contact with the surface 30 of the slide member 14 to store energy in the hinge portion 31 so that when the operator releases the slide member 14 while in the position illustrated in FIG. 4, the arm 29 will attempt to spring outwardly and thereby push against the stop 33 and move the slide member 14 back to the position illustrated in FIG. 3 where the cam follower 12 is moved out of its resetting position to its highest water level setting illustrated in FIG. 3. In this manner, if the operator forgets to reposition the slide member 14 after affecting a resetting operation therewith, at least the selector cam 14 will be disposed in its highest water level setting position thereof so that the laundry machine can continue to function in its normal manner during the remainder of the cycle of operation thereof.

One plastic material that has been found to be satisfactory in forming the slide member 14 and the integral spring arm 29 so as to function in the manner previously described is a plastic sold by the Dupont Co. of Wilmington, Del., under the trademark DELRIN.

Therefore, it can be seen that the slide member 14 can be molded as a one-piece structure so as to have the spring arm 29 integral therewith and thereby define a spring means that is generally indicated by the reference numeral 35 that is carried by the cam means 14 to move the cam means 14 from its resetting position in the manner previously described.

From the above, it can be seen that the control device 10 of this invention can be formed of relatively few parts in a simple manner by the method of this invention to operate in a manner now to be described.

When it is desired to set a particular water level setting for the control device 10, the operator merely grasps the handle 27 of the cam member 14 and slides the same to the desired water level setting position whereby the cam surface 15 thereof sets the cam follower 12 to such setting and the control device 10 will thereafter provide a water level in the laundry machine being associated therewith to a level that corresponds to the setting of the slide member 14 in a manner well known in the art.

However, should the operator after having made a selection of a certain water level, desire to have additional water directed into the laundry chamber after the water level has actuated the switch inside the control device 10, the operator moves the slide member 14 from its previously set water level position to the position illustrated in FIG. 3 and subsequently to the position illustrated in FIG. 4 whereby the arm 29 makes contact with the stop 33 and is moved against the surface 30 of the cam member 14 to store energy in the hinge portion 31 thereof so that when the operator subsequently releases the slide member 14, the arm 29 will attempt to spring outwardly and thereby force the cam member 14 from the position illustrated in FIG. 4 back to the position illustrated in FIG. 3. In this manner, the cam follower 12 is moved out of its resetting position into the highest water level setting position thereof so that should the operator not subsequently move the cam member 14 to another water level setting position thereof, at least the control device 10 will cause a filling of the laundry chamber to the highest water level setting thereof as provided by the slide member 14 being disposed in the position illustrated in FIG. 3.

Therefore, it can be seen that this invention not only provides an improved water level control device, but also this invention provides a method of making a water level control device.

While the form and method of this invention now preferred have been illustrated and described as required by the Patent Statute, it is to be understood that other forms and method steps can be utilized and still fall within the scope of the appended claims.

What is claimed is:

1. In a water level control device having a cam follower for setting the desired water level setting for said control device and a movable cam means having a cam surface engaging said cam follower to set the same in desired positions, said cam surface having a reset portion for resetting said control device when said reset portion is disposed against said cam follower, said control device having a spring means that cooperates with said cam means to tend to move said cam means from its resetting position when said reset portion is disposed against said cam follower, the improvement wherein said spring means is integral and homogeneous with said cam means whereby said cam means and said spring means comprises a one-piece homogeneous structure.

2. A water level control device as set forth in claim 1 wherein said spring means comprises a hinge-like part of said cam means.

3. A water level control device as set forth in claim 1 wherein said cam means comprises a slide member slideably carried by said control device.

4. A water level control device as set forth in claim 3 wherein said slide member has opposed ends, said spring means being disposed at one of said opposed ends.

5. A water level control device as set forth in claim 4 wherein said spring means comprises a hinge-like part of said one end of said slide member.

6. A water level control device as set forth in claim 1 wherein said spring means and said cam means are in aligned relation.

7. A water level control device as set forth in claim 6 wherein said aligned relation is a straight line relation.

8. A water level control device as set forth in claim 7 wherein said cam means has opposed ends, said spring means being disposed adjacent one of said ends of said cam means.

9. In a water level control device having a cam follower for setting the desired water level setting for said control device and a movable cam means having a cam surface engaging said cam follower to set the same in desired positions, said cam surface having a reset portion for resetting said control device when said reset portion is disposed against said cam follower, said control device having a spring means that cooperates with said cam means to tend to move said cam means from its resetting position when said reset portion is disposed against said cam follower, the improvement wherein said spring means is integral with said cam means, said cam means and said spring means comprising a one-piece structure, said cam means comprising a slide member slideably carried by said control device, said slide member having opposed ends, said spring means being disposed at one of said opposed ends, said spring means comprising a hinge-like part of said one end of said slide member, said hinge-like part comprising an arm normally disposed spaced from said slide member while being movable against said slide member in opposition to the natural bias of said arm to remain spaced from said slide member.

10. A water level control device as set forth in claim 9 wherein said control device has a stop, said arm of said slide member being engageable with said stop as said reset portion engages said cam follower.

11. A water level control device as set forth in claim 10 wherein said reset portion is disposed adjacent the other of said opposed ends of said slide member.

12. A water level control device as set forth in claim 11 wherein said slide member is formed from plastic material.

* * * * *